United States Patent [19]

Weinberg

[11] 4,024,032

[45] May 17, 1977

[54] ELECTROCHEMICAL ACYLOXYLATION OF CERTAIN AROMATIC COMPOUNDS

[75] Inventor: Norman L. Weinberg, East Amherst, N.Y.

[73] Assignee: Hooker Chemicals & Plastics Corporation, Niagara Falls, N.Y.

[22] Filed: Mar. 31, 1975

[21] Appl. No.: 563,532

[52] U.S. Cl. ..... 204/59 R; 204/72
[51] Int. Cl.[2] ..... C25B 3/00; C25B 3/10
[58] Field of Search ..... 204/59 R, 72, 78

[56] References Cited

UNITED STATES PATENTS

| | | | |
|---|---|---|---|
| 3,252,876 | 5/1966 | Koehl | 204/59 R |
| 3,252,877 | 5/1966 | Koehl | 204/59 R |
| 3,347,758 | 10/1967 | Koehl | 204/59 R |
| 3,448,021 | 6/1969 | Koehl | 204/72 |

OTHER PUBLICATIONS

Renaud et al., Can. J. Chem. vol. 50, pp. 3084, 3085 (1972).

Technique of Electroorganic Synthesis by Weinberg, pp. 265–271, pub. by John Wiley & Sons, N.Y. 1974.

*Primary Examiner*—F.C. Edmundson

*Attorney, Agent, or Firm*—Peter F. Casella; William J. Crossetta, Jr.; William R. Devereaux

[57] ABSTRACT

This invention provides a process for the electrochemical acyloxylation of aromatic compounds ring-substituted with an electron-withdrawing moiety and having a replaceable nuclear hydrogen. An anhydrous liquid comprising the aromatic substrate and the anion of a strong carboxylic acid provided by a strong carboxylic acid or the salt of a strong carboxylic acid is electrolyzed to produce a nuclear-substituted acyloxy derivative of the aromatic substrate wherein the acyloxy group replaces a nuclear hydrogen.

35 Claims, No Drawings

ELECTROCHEMICAL ACYLOXYLATION OF CERTAIN AROMATIC COMPOUNDS

FIELD OF THE INVENTION

This invention relates to the electrochemical synthesis of acyloxy derivatives of substituted aromatic compounds. More particularly this invention relates to a process for the preparation of intermediate compounds having utility as precursors for phenols bearing electron-withdrawing moieties.

DESCRIPTION OF THE PRIOR ART

The search for efficient synthesis of phenolic compounds, for use, e.g., in the manufacture of synthetic resins or pharmaceuticals, has resulted in a number of chemical methods utilized with varying degrees of success with regard to cost, yield, and purity of the desired aromatic alcohol. Well-known prior art processes for introducing the hydroxyl-group into an aromatic nucleus include allowing an aryl halide to react with sodium hydroxide at high temperature and pressure, allowing polynitro-aromatics to react with sodium hydroxide at elevated temperatures, allowing the decomposition of aryl diazonium salts in aqueous solution, and fusing aromatic sulfonates with sodium hydroxide at elevated temperatures.

However, the aforementioned routes are unsuitable alternatives if the sought-after phenol contains, for example, a strong electron-withdrawing substituent which decomposes in high temperature caustic alkali treatment.

Furthermore, the cost of the resulting phenol may be prohibitively high due to low final yield because of the number of steps involved in a reaction sequence.

In some instances, depending upon the elected synthetic route, it may be impossible to obtain any significant quantity of a given isomer of a phenol bearing an electron-withdrawing group because of the controlling mechanism.

One avenue of approach to this problem has been to synthesize an aromatic compound having both a substituent group sought-after in the final product and a group easily hydrolysed to the corresponding isomeric hydroxyl group, and subsequently hydrolyzing said aromatic compound.

Electrochemical synthesis of acyloxy derivatives of certain substituted benzenes is known. The conversion of these acyloxy derivatives to the corresponding phenols is also known. U.S. Pat. No. 3,347,758 discloses the nuclear acyloxylation of benzene substituted with a group such as alkyl, mononuclear aryl, alkoxy, mononuclear aryloxy, acylosy, or acylamido, with the preferred substituents being electron-donating alkyl groups. However, it is disclosed that benzene substituted with a group such as nitro, cyano, hydroxy, amino, chloro, bromo and the like is to be avoided. Controlled electrolysis of an anhydrous solution of an above-identified substituted benzene, e.g., toluene, anhydride can yield a tolyl acetate according to the above-identified patent disclosure.

It is further disclosed that the alkanoic acids suitable for use in the process of the U.S. Pat. No. 3,347,758 are the C-2 to C-10 alkanoic acids. Preferred are the C-2 to C-6 acids such as acetic, propionic, butanoic, and pentanoic and their isomers, and the various hexanoic acids.

Another study relating to anodic acetoxylation of aromatic compounds appears in a paper presented by L. Eberson, *Journal of the American Chemical Society*, Vol. 89:18, pp. 4669–4677 (1967). Eberson discloses, (p 4672) inter alia, that a substituted aromatic such as benzotrifluoride which contains the strongly electron-withdrawing trifluoromethyl ($F_3C$—) group does not undergo acetoxylation under specified reaction conditions comprising the use of glacial acetic acid 1.00 M in sodium acetate and 0.60 M benzotrifluoride, and anode potential of 2.4 volts vs. saturated calomel electrode, and an electrolyte temperature of 30°C. Eberson further discloses that since a substituent such as the trifluoromethyl group lowers the energy of the highest filled orbital of the benzotrifluoride molecule, it is therefore more difficult to remove electrons from this orbital by an anodic oxidation process. Consequently, before one can attain an anode potential high enough for oxidizing benzotrifluoride, discharge of acetate ion will take place and be the predominant electrode reaction. Prusuant to a study of the true isomer ratios in anodic acetoxylation, Eberson also discloses that the halobenzenes can be anodically acetoxylated to some extent under the above identified conditions but no data with regard to current efficiency is provided.

U.S. Pat. No. 3, 448,021 discloses a method for the electrochemical side-chain acyloxylation of substituted benzenes as p-chlorotoluene or p-cyanotoluene comprising the use of a promoter such as cobalt acetate. U.S. Pat. Nos. 3,252,876 and 3,252,877 disclose the electrochemical synthesis of acyloxy derivatives of alkyl-substituted condensed ring aromatic compounds and unsubstituted condensed ring aromatic compounds respectively.

The electrochemical synthesis of the o-nitrophenyl ester of o-nitrobenzoic acid is disclosed in the earlier work of Schall, *Zeitschift fur Electroctrochemie*, 24, 154 (1918), where a solution of o-nitrobenzoic acid and acetic anhydride was oxidized at a platinum anode. Schall discloses that the actual equilibrium mixture contains potassium acetate and the mixed anhydride of o-nitrobenzoic acid and acetic acid. The electrolysis products isolated were o-nitrophenol, nitrobenzene, and the o-nitrophenyl ester of o-nitrobenzoic acid. The latter product is an acyloxylated derivative of an electron-withdrawing group or negatively substituted aromatic; however, its formation involves electrochemical decarboxylation followed by substitution of the acyloxy group at the the position of the lost carboxylic acid group. The Schall disclosure should be distinguished from the concept of the present invention which provides for the electrochemical acyloxylation of negatively substituted aromatics involving overall substitution by the acyloxy group of an aromatic hydrogen.

A review of the subject prior art is provided in the reference entitled *Technique of Electroorganic Synthesis*, John Wiley & Sons, 1974, Chapter IV, Part 3, (page 265 et seq), "Acylosylation of Aromatic Compounds".

SUMMARY OF THE INVENTION

It is an object of this invention to provide a novel process for the synthesis of derivatives of an aromatic compound containing a ring substituted electron-withdrawing moiety.

It is another object of this invention to provide a novel process for the nuclear acyloxylation of an aromatic compound containing a ring substituted electron-withdrawing moiety and a replaceable nuclear hydrogen.

It is a further object of this invention to provide a novel process for the synthesis of aromatic hydrocarbon compounds containing a ring substituted electron-withdrawing moiety and another substituent readily convertible to a phenolic hydroxy group in the corresponding isomeric position.

A more specific object of this invention is to provide a novel process for the synthesis of ring substituted aromatic hydrocarbons containing an electron-withdrawing group substituent and an acyloxy group substituent derived from a strong carboxylic acid.

Other objects of this invention will be readily apparent from a consideration of the specification and the claims to this invention.

In accordance with the aforementioned objects this invention provides for the introduction of an acyloxy group into the nucleus of an aromatic ring containing at least one ring-substituted electron-withdrawing moiety and a replaceable nuclear hydrogen by a process comprising electrolyzing an anhydrous liquid comprising said nucleus and an anion of a strong carboxylic acid, which results in the substitution of an acyloxy group corresponding to the anion of a strong carboxylic acid for the nuclear hydrogen. More particularly, this invention provides for the introduction of an acyloxy group into the nucleus of a molecular aromatic compound containing at least one ring-substituted electron-withdrawing moiety and a replaceable nuclear hydrogen by process comprising electrolyzing an anhydrous solution comprising said aromatic compound and an anion of a strong carboxylic acid. In the latter instance, the reaction medium contains preferably both a strong carboxylic acid and an alkali metal, alkaline earth metal, quaternary ammonium, of quaternary phosphonium salt of a strong carboxylic acid. Optionally, the reaction mixture may contain a supporting electrolyte and a carboxylic acid anhydride.

The term "aromatic substrate" refers to an aromatic nucleus, ring substituted with at least one electron-withdrawing moiety, and having a replaceable nuclear hydrogen, which exists as a molecular compound or as the cationic component of an organic salt.

The terms "substrate", "nucleus", and "anion" encompass both the description of chemical entities and their use in the aggregate.

The term "electron-withdrawing moiety" encompasses substituents, such as trifluoromethyl, nitro, or carboxylic ester, which are strong electron-withdrawing groups, and electron-withdrawing atomic radicals such as chloride. Such moieties, when bonded to an aromatic ring, heretofore have rendered anodic nuclear acyloxylation of the respective aromatic substrates difficult if not impossible to achieve. Such moieties are also referred to in the art as electronegative substituents.

One having skill in the art will recognize that while theoretical considerations concerning the relative contributions of resonance and inductive effects of the substituent moieties upon the electron distribution of the aromatic substrate molecules may prove of value in elucidating some of the phenomena which result from the practice of this invention, an understanding or discussion of such theoretical considerations is not necessary for the successful practice of this invention.

By "strong carboxylic acid" is meant a carboxylic acid having a $pK_a$ value of less than about 3. Generally, such acids have an electron-withdrawing moiety bonded to the carboxyl carbon atom. A class of carboxylic acids having such $pK_a$'s are those which possess an electron-withdrawing atom or group in the $\alpha$-position, that is, bonded to the carbon atom adjacent to the carboxyl carbon atom. Examples of such acids are $\alpha$-halogen acetic acids including chloroacetic acid ($CLCH_2CO_2H$) and trifluoroacetic acid ($F_3CCO_2H$), cyanoacetic acid ($NCCH_2CO_2H$), and nitroacetic acid ($O_2NCH_2CO_2H$).

In general, it may be stated that as the strength of the electron-withdrawing influence of the aromatic substituent on the aromatic nucleus increases, correspondingly stronger carboxylic acids and salts are required, i.e., acids or salts of acids having smaller $pK_a$ values, in order to achieve good product yields and that a $pK_a$ ($H_2O$) at 25° C value of about 3 represents a practical and not absolute maximum value for an acid suitable for use in this invention.

DETAILED DESCRIPTION OF THE INVENTION

In order to more fully describe the subject invention, a general reaction mechanism for anodic acyloxylation is presented as depicted by the following reactions:

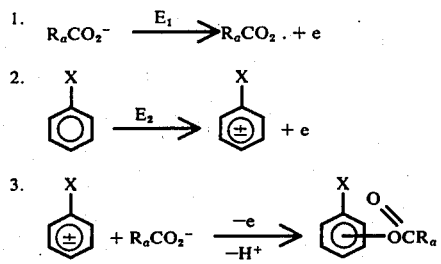

where X represents an aromatic substituent, $R_aCO_2^-$ represents a carboxylic acid anion, $E_1$ represents the discharge potential of the carboxylate, and $E_2$ represents the discharge potential of the aromatic. In general, acyloxylation occurs if $E_1$ is greater than $E_2$.

In accordance with this invention, it has been found that the acyloxylation of an aromatic nucleus, containing a strong electron-withdrawing substituent such as the trifluoromethyl group, is accomplished by electrolyzing the aromatic compound in the presence of $R_aCO_2^-$ described above where $R_aCO_2^{116}$ represents the carboxylate anion of acids having a $pK_a$ value of less than about 3 and preferably less than 2. Exemplary of such carboxylic acids are the following: mono-, di-, and trichloroacetic acid, mono-, di-, and tribromoacetic acid, mono-, di-, and trifluroacetic acid, $\alpha$-chloro and $\alpha,\alpha$-dichloropropionic acid, $\alpha$-fluoro-and $\alpha,\alpha$-difluoro butyric acid, $\alpha$-chloro $\alpha,\alpha$-difluoroacetic acid, and related acids.

Also feasible for use in this invention are acids such as cyano-acetic, nitro acetic, o-chlorobenzoic, o-bromobenzoic, o-nitrobenzoic, 2,4-dinitrobenzoic, maleic, malonic, phenylmalonic, oxalic, o-phthalic, salicyclic, and fumaric acid and related acids. Mixtures of these and equivalent acids are also contemplated for use in this invention.

Chloroacetic acid has a $pK_a(H_2O)$ at 25° C of 2.85 whereas the same $pK_a$ value for acetic acid is 4.76. The $pK_a$ values for some of the acids feasible for use in this invention are provided in Table I or can be readily calculated from the generally accepted dissociation constants. Table II provides Ka's for acids outside of the scope of this invention for purposes of comparison.

TABLE I

| CARBOXYLIC ACID | $K_a(H_2O)$ at 25° C | $pK_a(H_2O)$ at 25° C |
|---|---|---|
| chloroacetic | $1.4 \times 10^{-3}$ | 2.86 |
| dichloroacetic | $5 \times 10^{-2}$ | 1.48 |
| trichloroacetic | $2 \times 10^{-1}$ (18° C) | 0.70 |
| bromoacetic | $1.38 \times 10^{-3}$ | 2.69 |
| α-chloropropionic | $1.47 \times 10^{-3}$ | 2.83 |
| α-bromopropionic | $1.08 \times 10^{-3}$ | — |
| α-chlorobutyric | $1.4 \times 10^{-3}$ | 2.86 |
| cyanoacetic | $4 \times 10^{-3}$ | 2.45 |
| trifluoroacetic | * | 0 |

* generally accepted as completely dissociated in aqueous solution - having a $pK_a$ $(H_2O)$ at 25° C value of zero.

TABLE II

| CARBOXYLIC ACID | $K_a(H_2O)$ at 25° C | $pK_a(H_2O)$ at 25°C |
|---|---|---|
| acetic | $1.75 \times 10^{-5}$ | 4.76 |
| propionic | $1.4 \times 10^{-5}$ | 4.87 |
| β-chloropropionic | $8.6 \times 10^{-5}$ | 3.98 |
| β-bromopropionic | $9.8 \times 10^{-5}$ | — |
| n-butyric | $1.48 \times 10^{-5}$ | 4.81 |
| β-chlorobutyric | $8.9 \times 10^{-5}$ | 4.05 |
| n-valeric | $1.6 \times 10^{-5}$ | 4.82 |
| vinylacetic | $3.8 \times 10^{-5}$ | 4.34 |
| benzoic | $6.5 \times 10^{-5}$ | 4.19 |
| phenylacetic | $5.6 \times 10^{-5}$ | 4.28 |

One having skill in this art will recognize that the acidity of a given carboxylic acid is enhanced by the inductive or electron attracting character of the group adjacent the carboxyl group and, accordingly, the acidity varies with the electronegativity of the moiety adjacent the carboxyl group.

The salt of the carboxylic acid which preferably is present in the electrolyte may be a salt of the same or different strong carboxylic acid. Suitably the cation of the salt may be selected from the group of alkali metals, alkaline earth metals, or quarternary phosphoniums, sulfoniums, etc. Typically, the cations may be sodium, lithium, rubidium, cerium, magnesium, calcium, barium strontium, tetramethyl ammonium, tetraethy ammonium, etc. Because of their availability and effectiveness, the sodium and potassium salts are preferred. Other salts suitable for use in this invention may be formed in situ by combining a suitable acid with a tertiary amine or an aromatic amine such as pyridine to produce, for example, pyridinium trifluoroacetate. One function of the salts is to increase the conductivity of the medium.

The aromatic compounds containing at least one ring substituted electron-withdrawing moiety and having a replaceable nuclear hydrogen can be either monocyclic or polycyclic aromatic hydrocarbons such as benzenes, napthalenes, anthracenes, etc., or heterocycles. Representative of the aromatic heterocycles are those containing oxygen, nitrogen, or sulfur as the heteroatom and include the furans, benzofurans, pyrroles, pyridines, pyridazines, pyrazines, quinolines, isoquinolines, thiophenes, etc. The substrate aromatic compound can also contain electron-donating substituents such as an alkyl group, e.g., methyl, tertiary butyl, n-hexyl, etc., or other substituents which decrease the oxidation potential of the aromatic compound. One having skill in this art will recognize that with regard to considerations concerning the acyloxylation susceptibility of a polycyclic nucleus such as, e.g., napthalene substituted with an electron-withdrawing moiety, competing electron-withdrawing and electron-donating effects are present at the ring bearing the electron-withdrawing moiety due to the electron-donating influence of the adjacent aromatic portion of the molecule.

Representative of the electron-withdrawing substituents ring bonded to an aromatic nucleus are the following moieties: nitro ($-NO_2$), nitroso (—NO), cyano (—CN), carboxyl ($—CO_2H$), carboxylic ester ($—CO_2R$), carboxylic acid anhydride ($—CO_2COR$), aldekydic carbingal (CHO) keto (—COR), acyl halide (—COX), amido ($—CONH_2$), substituted amido ($—CON(R)_2$), sulfoxide (—SOR), sulfone (sulfone ($—SO_2R$), sulfonate ($—SO_3R$), sulfonium ($—S^+(R)_2$), azo (—NNR), azoxy (—NONR where the oxygen atom is bonded to either N atom), fluoro (—F), chloro (—Cl), bromo (—Br), phosphine oxides ($—P(O)(R)_2$), ($—P(O)HR$), ($—P(O)RX$), quaternary phosphoniums ($—P^+H(R)_2$), ($—P^+H_2R$), quaternary ammoniums ($—N^+H_2R$), quaternary ammoniums ($—N^+(R)_3$), ($—N^+H(R)_2$), ($—N^+H(R)_2$), ($—P^+H_2R$), iodoso (—IO), substituted indoso ($—IX_2$, $—I(O_2CR)_2$) such as iodobenzene dichloride, iodosobenzenediacetate, or iodosobenzenetrifluoroacetate, iodoxy ($—IO_2$), chloronium ($Cl^+R$), bromonium ($—Br^+R'$) and iodonium ($—I^+R'$) where R' is aryl, where X is halide and where R represents a moiety bonded to the electron-withdrawing portion of the molecule adjacent the aromatic ring. Representative but not limitative of such R moieties are the straight or branched chain lower alkyls having from one to eight carbon atoms, straight or branched chain higher alkyls, aryls such as phenyl, napthyl, etc., heterocycles, or substituted alkyls, aryl and heterocycles, i.e., those containing the same substituents as represented above or other chemical moieties desired.

Further representatives of the electron-withdrawing substituents ring-bonded to an aromatic nucleus are alkyls bearing electron-withdrawing moieties in the alpha position. The electron-withdrawing moieties can be selected from the group represented above. Examples of such α-electron-withdrawing moiety alkyls are α -cyanoalkyl, e.g., ($—CH_2CH$), α -nitroalkyl, e.g., ($—CH_2NO_2$), and the α -haloalkyls such as the saturated fluorocarbon ($—CF_2CF_2R$), where R is as defined above, difluoromethyl ($—CHF_2$), and the perhaloalkyls such as trifluoromethyl ($—CF_3$).

One skilled-in-the-art will recognize that the electron-withdrawing influence of the α -electron-withdrawing moiety alkyls is exerted upon the aromatic nucleus through the alkyl carbon atom bonded to the ring.

A further class of nuclear-bonded electron-withdrawing substituents is the halogenated ethylidenes ($—CX'=C(X'')_2$) where X' can be hydrogen, halogen, or trihalomethyl and X'' can be halogen or trihalomethyl. Representative of such halogenated ethylidenes are groups such as β, β -difluorovinyl ($—CH=CF_2$), or α -trifluoromethyl β, β -difluorovinyl ($—C(CF_3)=CF_2$).

The above-detailed description of electron-withdrawing substituents ring-bonded to an aromatic nucleus is intended to be illustrative of each moieties and not a limitation thereof as equivalents will be readily suggested upon a reading of this invention disclosure. One having skill in the electrochemical art will recognize that competing chemical or electrochemical reactions of the substituent groups may occur along with the nuclear acyloxylation reaction.

With regard to an aromatic compound substituted with a group such as the quaternary ammonium moiety, it is to be recognized that one mode within the scope of this invention of effecting nuclear acyloxylation is to subject an anhydrous melt of a compound such as $ArN^+(R)_3^-$ An to electrolytic acyloxylation conditions.

In the formula $ArN^+(R)_3^-$ An, Ar represents an aromatic group such as phenyl, R is as defined above, and $^-$An represents the anion of an acid within the scope of this invention, i.e., those acids having a $pK_a(H_2O)$ at 25° C value of less than about 3. The melt can also contain an acid HAn corresponding to $^-$ An or a different acid having a $pk_a$ $(H_2)$ at 25° C value of less than about 3. Similarly, the considerations which apply to the quaternary ammonium substituted aromatics discussed above also apply to the quaternary phosphoniums, sulfoniums, chloroniums, bromoniums and iodoniums.

It is to be recognized that when this specification refers to an aromatic nucleus ring-substituted with quaternary ammonium, quaternary phosphonium, sulfonium chloronium, bromonium, or iodonium moieties, the same terminology, e.g., quaternary ammonium, can apply to the cationic component of the subject organic salt as well as to the salt per se. In such instances, the cationic component contains the aromatic nucleus which is acyloxylated by a carboxylic acid anion according to the process of this invention.

Cosolvent diluents for the reaction mixture may be used and include anhydrous liquid hydrogen fluoride and sulfur dioxide, alkanoic acids such as acetic acid, acetonitrile (preferably used with a quaternary ammonium salt), nitromethane, methylene chloride, and aromatic compounds that have a very high anodic discharge potential such as nitrobenzene.

In accordance with a preferred embodiment of this invention, an electrolytic process is provided wherein an aromatic compound containing a strong electron-withdrawing group, such as benzotrifluoride, is dissolved in a strong carboxylic acid, such as trifluoroacetic acid containing an alkali metal salt such as sodium trifluoroacetate and trifluoroacetic anhydride is included to insure anhydrous conditions for the electrolysis.

The solution is subjected to agitation and electrolyzed at ambient temperature using a conventional anode. Preferably, higher temperatures are employed, by which means the solution viscosity is lowered and hence the conductivity increased. Upon completion of the electrolysis reaction, the resulting solution is treated with water and subsequently extracted with a suitable organic solvent such as chloroform. Following the separation, the solvent extract, containing the acyloxylated aromatic products, is dried by conventional methods and the extraction solvent removed by conventional means such as flash evaporation.

The residue comprises a misture of the ortho-, meta-, and para-trifluoroacetate esters of benzotrifluoride which can be isolated by means of conventional methods such as distillation or recrystallization.

Alternately, the crude residue or the purified esters can be hydrolyzed by known means to yield the corresponding phenolic compounds. If the primary objective is preparation of the aforementioned phenols, rather than the intermediate ester precursors, recovery of the carboxyl moiety of the acyloxylating agent and conversion to a metal salt for recycling to the electrolytic acyloxylation process is economically desirable. Accordingly, utilization of a readily available, inexpensive, and revoverable acyloxylating agent, such as trichloroacetic acid and its sodium salt or other halogenated acetic acids are especially preferred in the practice of this invention.

In accordance with one embodiment of this invention, electrolytic acyloxylation can be conducted in a strong carboxylic acid solution. However, in this embodiment, it is preferred to provide also an alkali metal, alkaline earth metal, or quaternary ammonium salt of a strong carboxylic acid, and preferably of the same carboxylic acid used as the acid solvent, in the reaction system since electrochemical polymerization of the aromatic substrate may occur in its absence or the desired acyloxylated product may be formed in low yield due to the low concentration of anions. Provision of the salt corresponding to the solvent acid facilitates purification of the reaction mass and resolution of the specific compound desired. As previously mentioned, provision of a salt also facilitates the reaction by increasing the conductivity of the electrolytic medium. Other salts useful in the practice of the invention as support electrolytes include p-toluenesulfonate, trifluoromethylsulfonate, perchlorates, tetrafluoroborates, and hexafluorophosphates.

The concentration of the carboxylate salt or additional supporting electrolytes in the strong carboxylic acid solvent medium range may range as high as about 10 molar; high concentrations do not contribute to appreciably better yields of reaction product. Beneficial results have been obtained with carboxylate salt concentrations in the range of from about 0.1 to about 1.5 molar and this concentration is preferred.

The concentration of the, aromatic substrate substituted with the electron-withdrawing group, is suitably from about 0.01 to about 10 molar, and preferably from about 0.02 to about 5 molar. However, in some instances the aromatic substrate itself, e.g., nitrobenzene, may be sufficiently conducting in the presence of a suitable supporting electrolyte, e.g., a quaternary ammonium salt of trifluoroacetic acid which is, per se, the acyloxylating agent.

Alternative embodiments of this invention include subjecting a solution consisting of, for example, tetrabutylammonium trifluoroacetate and nitrobenzene to electrochemical acyloxylation conditions which result in the replacement of a nuclear hydrogen of the nitrobenzene nucleus with the trifluoroacetoxy group. Similarly, a solution consisting of tetraethylammonium trifluoroacetate, benzotrifluoride, nitromethane, with a supporting electrolyte such as tetraethylammonium perchlorate may be according to the process of this invention to effect trifluoroacetoxylation of the benzotrifluoride nucleus.

The acyloxylation process of this invention may be conducted at temperatures ranging from slightly above the freezing point of the reaction solution to temperatures attained at reflux conditions. Conveniently, temperatures from about 0° to about 50° Centigrade are utilized with higher temperatures decreasing solution viscosity and hence increasing conductivity. Pressure conditions are not critical; thus, superatmospheric, subatmospheric, or atmospheric pressures are preferred.

Static or flow cells can be utilized in the practice of this invention and include the capillary gap cell, batch cell, plate and frame flow cell, or fluidized bed cell techniques. One skilled in the art will appreciate that the selection of cell design such as one providing for separation of anode and cathode compartments by means of an ion-exchange membrane, may be contingent upon the ease of reduction of the aromatic substrate selected or the resulting acyloxylation product. Generally, the electrodes can be of the rotated or stationary type and may be constructed of any conductive material which is inert to the reagents contacting said electrodes and will not be passivated. Examples of such electrode materials as anodes are carbon, lead, lead dioxide, noble metals and their oxides, e.g., platinum and platinum oxide, as well as noble metal or noble metal oxides as a coating on a valve metal such as titanium. The latter mentioned electrode materials are materials of choice in conventional electrodes known as "dimensionally stable anodes". As cathodes one can utilize, for example, carbon, platinum, lead or copper.

Electrode current densities for use in the acyloxylation process of this invention are generally provided in the range of from about 0.001 to about 10 amperes per square centimeter of anode surface, and preferably from 0.01 to 1.0 A cm. The potential of the anode should be provided at a value of at least +2.0 to about +5.0 volts, as measured against the saturated calomel electrode (aqueous) and preferably from about +2.5 to +5 volts. Optimally, the anode potential, as measured against the sce should be in the range of 3 to 5 volts. One skilled in the art will recognize that the aforementioned range will depend upon variables such as the aromatic substrate selected as well as the chemical and electrochemical variables, a discussion of which is found in an article entitled "An Organic Chemist's Approach to Electroorganic Synthesis", Chem. Tech., March 1974, (pp. 184–189).

Alternating current, preferably less than 60 cycles/-sec /sec can be used providing the starting material or product is not reduced at the potential of the current reversal. A single compartment cell is used with alternating current. Noble metal electrodes or those with low hydrogen overpotential in protic media are preferred as on the cathode swing $H_2$ evolution will then be more likely to occur than reduction of the starting material or the acyloxylated product.

The use of direct current is the more usual manner of practicing of this invention, however, pulsed direct current is found beneficial for reasons including the cleansing of the electrode surface and providing time for slower chemical reactions to occur.

Diaphragms or membranes may be used to separate the anode and cathode compartment of the electrolysis cell, although such use is not a requirement in protic, especially if the cathode material has a low hydrogen overpotential.

The process of this invention will be illustrated by the following examples.

EXAMPLE I

A glass reaction vessel was charged with an electrolyte solution consisting of trifluoroacetic acid having a 0.5 molar concentration of sodium trifluoroacetate and 0.2 molar concentration of benzotrifluoride. A small quantity of trifluoroacetic anhydride was used to insure an anhydrous solution condition. The solution was magnetically stirred at room temperature, i.e., about 25° Centigrade. A Stackpole amorphous carbon (¼ inch rod) anode was utilized at a potential of 3–5 volts (vs. sce) controlled by means of a PAR potentiostat and direct current was passed through the solution effecting the acyloxylation. After passage of about 2 to 2.5 Faradays per mole (of aromatic substrate), the electrolysis solution was poured into an excess of water, and the aqueous mixture extracted several times with chloroform. The combined organic extract was dried over anhydrous $MgSO_4$, the solution filtered, and the filtrate solvent evaporated to obtain the crude product as a residue.

Analysis of this crude product by vapor phase chromatography provided data on the isomeric ratio of acyloxylated products and current efficiency which are provided in Table III.

EXAMPLE II

The same procedure was followed as in Example 1, except that the concentration of sodium trifluoroacetate was 1.0 M and a platinum anode was used. The results are described in Table III.

EXAMPLE III

The same procedure was followed as in Example I except that a 0.5 M concentration of sodium acetate in acetic acid was used as the acyloxylation medium in the presence of a platinum anode. The results are described in Table III.

EXAMPLE IV

The same general procedure was followed as in Example I except that the aromatic substrate used was chlorobenzene, the electrolysis medium was 1.3M potassium trifluoroacetate in trifluoroacetic acid, and the anode used was carbon. The results are described in Table III.

EXAMPLE V

Example IV was repeated using a platinum anode in place o carbon. The results are described in Table III.

TABLE III

| Aromatic Comp'd | Electrolyte Solvent | Anode | Products isomer ratio (Current Efficiency) |
|---|---|---|---|
| BTF | O ‖ 0.5M $NaOCCF_3$/TFA | Carbon | Trifluoroacetates o/p=0.30 (56%) Phenols (3.7%) |
| BTF | O ‖ 1.0M $NaOCCF_3$/TFA | Platinum | Trifluoroacetates o/p=0.39 (57%) Phenols (9.7%) |
| BTF | O ‖ 0.5M $NaOCCH_3$/HOAc | Platinum | Acetates o/p=0.365 (1.4%); Phenols (0.03%) |
| PhCl | O ‖ 1.3M $KOCCF_3$/TFA | Carbon | Trifluoroacetates o/p=0.29 (62.8%); Phenols (3%) |
| PhCl | O ‖ 1.3M $KOCCF_3$/TFA | Platinum | Trifluoroacetates o/p=0.50 (55.3%); Phenols (14.7%) |

LEGEND:
BTF = benzotrifluoride
PhCl = chlorobenzene
TFA = trifluoroacetic acid
o/p — mole ratio of ortho to para isomer Table IV provides comparative data relating the $pK_a$ ($H_2O$) at 25° C of some carboxylic acids to the current efficiency of the respective acyloxylation of benzotrifluoride.

TABLE IV

| Carboxylic Acid | $pK_a$ ($H_2O$) 25° C | Total CE | Anode |
|---|---|---|---|
| $F_3CCO_2H$ | (O) | 66.7% | Platinum |

TABLE IV-continued

| Carboxylic Acid | $pK_a$ ($H_2O$) 25° C | Total CE | Anode |
|---|---|---|---|
| $ClCH_2CO_2H$ | 2.86 | 10.3% | Platinum |
| $HCO_2H$ | 3.75 | 4.3% | Platinum |
| | | 4.6% | Carbon |
| $CH_3CO_2H$ | 4.76 | 1.4% | Platinum |

EXAMPLE VI

The constant potential electrolysis of nitrobenzene (5 ml, 0.049 moles) at 4.3 V (vs. sce) was conducted in a mixture of 80 ml of 0.5 M of $F_3CC0_2Na/F_3CCO_2H$ and 2 ml $(F_3CCO)_2O$ with the aid of a PAR potentiostat (model 174) and a three compartment cell. A platinum anode (10 $cm^2$) and a carbon rod cathode were used as the working and auxiliary electrode respectively. Following the passage of 2671 coulombs, the anolyte was poured into water and extracted with chloroform. The chloroform solution was dried over anhydrous $MgSO_4$, filtered and subsequently evaporated under reduced pressure. Gas chromatograph - mass spectral analysis of the hydrolyzed residue indicated the presence of nitrophenols (m/e = 139 for the molecular ion). Further gas chromatographic analysis via comparison of the residue with standards showed that the nitrophenols were formed in 8.1% yield at a current efficiency of 29% with the following isomer distribution o/m/p :: 2.6/4.3/1.1.

The commercially valuable increase in current efficiency when one utilizes the process of the present invention is exemplified in the following experiments where the nuclear substitution of 1,4-dichlorobenzene is effected.

EXAMPLE VII

A 3 compartment cell separated by glass frits containing platinum (10 $cm^2$) electrodes and a saturated calomel reference electrode was charged with 150 ml of an anhydrous trifluoroacetic acid solution 1M in sodium trifluoroacetate and containing 10% by volume trifluoroacetic anhydride. The solution in the anode compartment (100 ml) was magnetically stirred at room temperature.

The solution was subjected to mild heating while 24 g of 1,4-dichlorobenzene was added. Electrolysis was then conducted at 3.4 V at 40° C (initial *i*— 130 mA). After the passage of 19,040 coulombs the electrolysis was stopped and the anolyte worked up in a conventional manner except that the treatment with 400 mls of water was prolonged for one hour to promote hydrolysis of any ester constituents. The weight of the recovered crude product (oil) was 24.7 g. Gas chromatography showed the presence of 6.5 g of 2,5-dichlorophenol which indicates a current efficiency of 43%. Gas chromatography also indicated the presence of a lesser amount of the trifluoroacetoxy ester of 1,4-dichlorobenzene (1.2% CE) which gives a total current efficiency value of 44.2% for the reaction.

EXAMPLE VIII

A single compartment cell containing a platinum (10 $cm^2$) anode, a carbon rod cathode, and a saturated calomel reference with a luggin capillary probe positioned near the anode was charged with 300 ml of an anhydrous solution of acetic acid 0.5M in sodium acetate, 12.0 g of 1,4-dichlorobenzene, and a small amount of acetic acid anhydride. The solution was subjected to magnetic sitrring and a constant-potential electrolysis was conducted at 5.00 V and an initial current of 32.5 mA. Substantial hydrogen gas evolution occurred at the cathode while insignificant quantities of gas evolution occurred at the anode.

The electrolysis was stopped after 10,540 coulombs was passed. The electrolysis was poured into 500 ml of water and filtered. The filtered solid showed only a trace of the phenol ester product by gas chromatography. The filtrate was extracted with chloroform and, following the conventional separation procedure, yielded 1.5 g of an oil. Gas chromatography indicated that one-third of the recovered oil was the acetoxy derivative of 1,4-dichlorobenzene at a current efficiency of 4.4%.

One skilled in the art will appreciate that the variation between the preceding two experiments of some of the reaction parameters utilized in these experiments such as molarity of the salt, and nature of the cell and eletrodes, plays a minor role insofar as their effect on the surprising and unexpected difference in current efficiency of the reaction process is concerned.

The reference to various embodiments of the invention disclosed herein are intended to illustrate the invention and are not intended to limit it. One skilled in the art will appreciate that various changes can be made, and equivalents substituted, in the process of this invention without departing from its spirit and scope. Such modifications are considered to be within the scope of this invention.

In view of the foregoing disclosure I claim:

1. An electrochemical acyloxylation process comprising subjecting an anhydrous liquid comprising a. an aromatic substrate comprising an aromatic nucleus ring-substituted with at least one electron-withdrawing moiety and having at least one replaceable nuclear hydrogen, and b. an anion of strong carboxylic acid having a $pK_a$ ($H_2O$) at 25 ° C value of less than about 3 to electrolytic conditions sufficient to effect nuclear acyloxylation of said aromatic substrate wherein an acyloxy group corresponding to said anion replaces said hydrogen.

2. An electrochemical acyloxylation process comprising subjecting an anhydrous solution comprising a. a molecular aromatic compound ring-substituted with at least one electron-withdrawing moiety and having at least one replaceable nuclear hydrogen, and b. an anion of a strong carboxylic acid having a $pK_a$ ($H_2O$) at 25° C value of less than about 3 to electrolytic conditions sufficient to effect nuclear acyloxylation of said aromatic compound, wherein an acyloxy group corresponding to said anion replaces said hydrogen.

3. A process according to claim 2 wherein said aromatic compound is selected from the group consisting of aromatic hydrocarbons and aromatic heterocycles.

4. An electrochemical acyloxylation process comprising subjecting an anhydrous solution comprising a. a molecular aromatic compound ring-substituted with at least one electron-withdrawing moiety and having at least one replaceable nuclear hydrogen, b. a strong carboxylic acid having a $pK_a$ ($H_2O$) at 25° C value of less than about 3, and c. a salt of said carboxylic acid to electrolytic conditions sufficient to effect nuclear acyloxylation of said aromatic compound, wherein an acyloxy group selected from the group consisting of said strong carboxylic acid and said salt replaces said hydrogen.

5. A process according to claim 4 wherein said anhydrous solution comprises a carboxylic acid anhydride.

6. A process according to claim 4 wherein said anhydrous solution comprises a supporting electrolyte.

7. A process according to claim 4 wherein said strong caboxylic acid has a $pK_a$ ($H_2O$) at 25° C value of less than 2.

8. A process according to claim 7 wherein said $pk_a$ ($H_2O$) at 25° C value is less than 1.

9. An electrochemical acyloxylation process comprising subjecting an anhydrous solution consisting essentially of a. a molecular aromatic compound ring-substituted with at least one electron-withdrawing moiety, and having at least one replaceable nuclear hydrogen, b. a strong carboxylic acid having a $pK_a$ ($H_2O$) at 25° C value of about 3, and c. a salt of said carboxylic acid to electrolytic conditions sufficient to effect nuclear acyloxylation of said aromatic compound, wherein an acyloxy group selected from the group consisting of said strong carboxylic acid and said salt replaces said hydrogen.

10. A process according to claim 9 wherein said strong carboxylic acid has a $pK_a$ ($H_2O$) at 25° C value of less than 2.

11. A process according to claim 10 wherein said strong carboxylic acid has a $pK_a$ ($H_2O$) at 25° C value of less than 1.

12. An electrochemical acyloxylation process comprising subjecting an anhydrous solution comprising a. a molecular aromatic compound ring-substituted with at least one electron-withdrawing moiety and having at least one replaceable nuclear hydrogen, wherein said moiety is selected from the group consisting of $\alpha$ - haloalkyl, halogenated ethylidene, nitro, nitroso, cyano, carboxyl, carboxylic ester, carboxylic acid anhydride, carbonyl, keto, acyl halide, amido, substituted amido, sulfonium, sulfoxide, sulfone, sulfonate, azo, azoxy, fluoro, chloro, bromo, phosphine oxide, quaternary phosphonium, quaternary ammonium, iodoso, substituted iodoso, iodoxy, chloronium, bromonium, and iodonium, and b. an anion of a strong carboxylic acid having a $pK_a$ ($H_2O$) at 25° C value of less than about 3 to electrolytic conditions sufficient to effect nuclear acyloxylation of said aromatic compound, wherein an acyloxy group corresponding to said anion replaces said hydrogen.

13. A process according to claim 12 wherein said anion in said an hydrous solution is provided by a strong carboxylic acid having a $pK_a$ ($H_2O$) at 25° C value of less than about 3 and a salt of said acid.

14. A process according to claim 13 wherein said anhydrous solution comprises a carboxylic acid anhydride and a supporting electrolyte.

15. A process according to claim 12 wherein said aromatic compound is an aromatic heterocycle.

16. A process according to Claim 12 wherein said aromatic compound is an aromatic hydrocarbon.

17. A process according to claim 16 wherein said aromatic hydrocarbon ring-substituted with at least one electron-withdrawing moiety and having at least one replaceable nuclear hydrogen is selected from the group consisting of trifluoromethyl, carbonyl, and carboxylic ester substituted aromatic hydrocarbons.

18. A process according to claim 17 wherein said aromatic hydrocarbon is benzotrifluoride.

19. A process according to claim 17 wherein said aromatic hydrocarbon is selected from the group consisting of methyl benzoate and ethyl benzoate.

20. A process according to claim 17 wherein said aromatic hydrocarbon is benzaldehyde.

21. A process according to claim 16 wherein said aromatic hydrocarbon ring-substituted with at least one electron-withdrawing moiety and having at least one replaceable nuclear hydrogen is selected from the group consisting of fluoro, chloro, and bromo substituted aromatic hydrocarbons.

22. A process according to claim 21 wherein said aromatic hydrogen is selected from the group consisting of dichlorobenzenes.

23. A process according to claim 12 wherein said strong carboxylic acid has a $pK_a$ ($H_2O$) at 25° C value of less than 2.

24. A process according to claim 23 wherein said $pK_a$ ($H_2O$) at 25° C is less than 1.

25. An electrochemical acyloxylation process comprising subjecting an anhydrous solution consisting essentially of a. a molecular aromatic hydrocarbon ring-substituted with at least one electron-withdrawing moiety and having at least one replaceable nuclear hydrogen wherein said moiety is selected from the group consisting of $\alpha$-haloalkyl, halogenated ethylidene, nitro, nitroso, cyano, carboxyl, carboxylic ester, carboxylic acid anhydride, carbonyl, keto, acyl halide, amido, substituted amido, sulfonium, sulfoxide, sulfone, sulfonate, azo, azoxy, fluoro, chloro, bromo, phosphine oxide, quaternary phosphonium, quaternary ammonium, iodoso, substituted iodoso, iodoxy, chloronium, bromonium, and iodonium, and b. a strong carboxylic acid having a $pK_a$ ($H_2O$) at 25° C value in the range of 0 to 3, and c. a salt of said strong carboxylic acid to electrolytic conditions sufficient to effect nuclear acyloxylation of said aromatic compound, wherein an acyloxy group selected from the group consisting of said strong carboxylic acid and said salt replaces said hydrogen.

26. A process according to claim 25 wherein said aromatic hydrocarbon is selected from the group consisting of trifluoromethyl, chloro, carbonyl, and carboxylic ester substituted aromatic hydrocarbons.

27. A process according to claim 26 wherein said aromatic hydrocarbon is benzotrifluoride.

28. A process according to claim 26 wherein said aromatic hydrocarbon is selected from the group consisting of methyl benzoate and ethyl benzoate.

29. A process according to claim 26 wherein said aromatic hydrocarbon is benzaldehyde.

30. A process according to claim 26 wherein said aromatic hydrocarbon is selected from the group consisting of dichlorobenzenes.

31. A process according to claim 26 wherein the $pK_a$ ($H_2O$) at 25° C value of said strong carboxylic acid is less than 2.

32. A process according to claim 31 wherein said $pK_a$ ($H_2O$) at 25° C value is less than 1.

33. An electrochemical acyloxylation process comprising subjecting an anhydrous liquid consisting essentially of the melt of an organic salt, wherein the cation of said salt comprises an aromatic moiety ring-substituted with at least one electron-withdrawing moiety and having at least one replaceable nuclear hydrogen and wherein the anion of said salt is an anion of a strong carboxylic acid having a $pK_a$ ($H_2O$) at 25° C value of less than about 3, to electrolytic conditions sufficient to effect nuclear acyloxylation of said aromatic moiety, wherein an acyloxy group corresponding to said anion replaces said hydrogen.

34. A process according to claim 33 wherein said organic compound is a quaternary ammonium compound and said $pK_a$ ($H_2O$) at 25° C value is less than 1.

35. An electrochemical acyloxylation process comprising subjecting an anhydrous liquid consisting essentially of an organic compound selected from the group consisting of quaternary ammonium, quaternary phosphonium, sulfonium, chloronium, bromonium, and iodonium, wherein the cation of said compound contains an aromatic moiety ring-substituted with at least one electron-withdrawing moiety and having at least one replaceable nuclear hydrogen, and wherein the anion of said compound is an anion of a strong carboxylic acid having a $pK_a$ ($H_2O$) at 25° C value of less than about 3, to electrolytic conditions sufficient to effect nuclear acyloxylation of said aromatic moiety wherein an acyloxy group corresponding to said anion replaces said hydrogen.

* * * * *

UNITED STATES PATENT OFFICE

CERTIFICATE OF CORRECTION

Patent No. 4,024,032 Dated May 17, 1977

Inventor(s) Norman L. Weinberg Page 1 of 2

It is certified that error appears in the above-identified patent and that said Letters Patent are hereby corrected as shown below:

Column 1, line 44, "hydrolysed" should read --hydrolyzed--; line 54, "acylosy" should read --acyloxy--. Column 2, line 59, "Acylosylation" should read --Acyloxylation--. Column 4, line 47, "$RaCO_2^{116}$" should read $RaCO_2^{\ominus}$--. Column 6, line 8, "aldekydic carbingal" should read --aldehydic carbonyl--; line 10, "sulfone (sulfone($-SO_2R$" should read --sulfone ($-SO_2R$) --; line 16, "phosphoniums ($-P^{+}H)R)_2$), ($-\overset{+}{P}H_2R$), quarternary ammoniums" should read --phosphoniums ($-\overset{\oplus}{P}(R)_3$), ($-\overset{\oplus}{P}H)R)_2$), ($-\overset{\oplus}{P}H_2R$), --; line 17, "quarternary ammoniums ($-N^{+}H_2R$), quarternary ammoniums ($-\overset{+}{N}(R)_3$), ($-\overset{+}{N}H(R)_2$), ($-\overset{+}{N}H(R)_2$), ($\overset{+}{P}H_2R$), iodoso" should read --quarternary ammoniums ($-\overset{\oplus}{N}(R)_3$), ($-\overset{\oplus}{N}H)R)_2$), ($-\overset{\oplus}{N}H_2R$), iodoso--; line 22, "chloronium ($Cl^{+}R$), bromonium ($-Br^{+}R'$) and" should read --chloronium ($-\overset{\oplus}{C}lR'$), bromonium ($-\overset{\oplus}{B}rR'$) and--; line 41, "e.g., ($-CH_2CH$)," should read --e.g., ($-CH_2CN$),--; line 60, "each moieties" should read --such moieties--. Column 7, line 11, "($H_2$)" should read --($H_2O$)--; line 55, "misture" should read --mixture--; line 68, "revoverable" should read --recoverable--. Column 8, line 21, "support" should read --supporting--. Col. 9, line 25, "against the sce should" should read --against the saturated calomel electrode should--; line 34, "60 cycles/sec/sec can be used" should read --60 cycles/sec can be used--; line 49, "in protic, especially" should read --in protic media, especially --.

UNITED STATES PATENT OFFICE

CERTIFICATE OF CORRECTION

Patent No. 4,024,032 Dated May 17, 1977

Inventor(s) Norman L. Weinberg Page 2 of 2

It is certified that error appears in the above-identified patent and that said Letters Patent are hereby corrected as shown below:

Column 12, line 21, "eletrodes" should read --electrodes--; line 24, "reference" should read --references--. Column 14, line 19, "aromatic hydrogen" should read --aromatic hydrocarbon --.

Signed and Sealed this thirtieth Day of August 1977

[SEAL]

Attest:

RUTH C. MASON
Attesting Officer

C. MARSHALL DANN
Commissioner of Patents and Trademarks